United States Patent [19]

King

[11] Patent Number: 5,066,137

[45] Date of Patent: Nov. 19, 1991

[54] STEAM INJECTION AND MIXING APPARATUS

[76] Inventor: Leonard T. King, 4109 Cedar Ave., Long Beach, Calif. 90807

[21] Appl. No.: 664,029

[22] Filed: Mar. 4, 1991

[51] Int. Cl.[5] ..... B01F 5/06

[52] U.S. Cl. ..... 366/336; 138/42

[58] Field of Search ..... 366/336, 337, 338, 339, 366/340; 138/38, 42

[56] References Cited

U.S. PATENT DOCUMENTS

| | | | |
|---|---|---|---|
| 3,923,288 | 12/1975 | King | 239/432 |
| 4,208,136 | 6/1980 | King | 366/328 |
| 4,372,734 | 2/1983 | Dolan | 366/336 |
| 4,534,659 | 8/1985 | Dourdeville | 366/338 |
| 4,614,440 | 9/1986 | King | 366/340 |

*Primary Examiner*—Robert W. Jenkins
*Attorney, Agent, or Firm*—Malcolm B. Wittenberg

[57] ABSTRACT

A device for the injection and mixing of steam into a fluid stream. A conduit which is cylindrically-shaped is provided for carrying a fluid such as water. A tubular conduit is then provided for discharging steam in the vicinity of a material mixing apparatus which possesses a plug for intermittently blocking steam discharge within the cylindrically-shaped conduit. A material mixing apparatus is positioned with the cylindrically-shaped conduit for mixing steam with the fluid stream, the material mixing apparatus being in the shape of the conduit and having openings containing mixing elements each of which induce a rotational angular velocity of the same sign to the fluid.

8 Claims, 1 Drawing Sheet

STEAM INJECTION AND MIXING APPARATUS

TECHNICAL FIELD OF THE INVENTION

The present invention deals with a device for the injection and mixing of steam into a fluid stream of, for example, water.

BACKGROUND OF THE INVENTION

It has long been recognized that an exceedingly efficient technique for heating liquids is to directly inject steam within the liquid to be heated. When steam is injected directly into a liquid, one can realize almost one hundred percent of the BTU's in the steam which are absorbed directly into the liquid. Unlike indirect heating by means of, for example, a heat exchanger, there is no condensate retaining unused sensible heat. Because of this high heat-transferability, direct steam injection can save a great deal in energy costs.

Direct steam injection systems offer other benefits as well when compared to heat exchangers and comparable indirect heating systems. A direct steam injection system can provide very accurate temperature control within several degrees fahrenheit and are efficient in that scale buildup does not become an issue. Systems of this nature also tend to be more compact than comparable heat exchange devices.

There are four basic types of direct steam injection systems, namely, the sparger, the mixing tee, the Venturi and the modulating injection system. The sparger is the simplest system in that it generally consists of nothing more than a perforated pipe discharging steam in a vented storage tank. However, these systems are not without their disadvantages. For example, they must be operated at a set and constant flow rate to prevent the hammering effect observed in steam/water systems. This is the result of operating at steam and water pressures which are at or near equilibrium.

Mixing tees comprise nothing more than steam and water lines which join a common conduit. Because separate lines are used for each fluid, capital equipment tends to be expensive and inconvenient to install.

Venturi systems are generally more acceptable than those previously discussed, but should be operated under conditions of constant steam pressure, inlet water pressure and outflow demand. If they do not, a hammering effect can again be observed as the steam and inlet water pressures approach an equilibrium condition. In addition, changes in these variables can result in varying outlet temperatures which may not be desired.

Prior attempts have even been made to employ static mixers for direct steam injection into a liquid stream. However, as in the other prior art approaches, the results have proven spotty with instability and lack of control problems being manifest.

FIG. 1, labeled "prior art" was reproduced from an article appearing in Chemical Engineering in its June 28, 1982, issue. The article, entitled "*Considered Direct Steam Injection for Heating Liquids*" by Pick illustrates a variable-orifice injector system with modulating steam control. More specifically, cylindrical tube 10 is shown as possessing steam inlet 1 which injects the steam into an injector tube 2 and piston 5. The piston is biased by spring 3 which acts to block or free holes contained in injector tube 2 depending upon steam pressure emanating from inlet 1. Bias is maintained by spring 3, the overall effect being to heat water entering from cold water inlet 6 as it emanates from cylindrical tube 10 at outlet 4. In light of the fact that this product has tiny holes, depending upon the quality of the water or liquid being used, the system can become plugged.

It is thus an object of the present invention to provide a modulating injection system for the introduction of steam to a fluid without the drawbacks as experienced in prior devices such as those shown in FIG. 1.

This and further objects will be more readily appreciated when considering the following disclosure and appended drawings wherein.

SUMMARY OF THE INVENTION

The present invention deals with a device for the injection and mixing of steam into a fluid stream of, for example, water. The device comprises of substantially cylindrically-shaped conduit having a longitudinal axis and substantially circular cross-section for carrying the fluid stream. The conduit is also provided with an inlet for accepting the fluid stream and an outlet for discharging the fluid stream along the longitudinal axis.

Means are provided for discharging steam substantially proximate the longitudinal axis of the cylindrically-shaped conduit. Material mixing apparatus for mixing the steam with the fluid stream is provided in the shape of the conduit. The material mixing apparatus comprises a plurality of openings having mixing elements which induce a rotational angular velocity to the fluid stream passing therethrough. The material mixing apparatus further is characterized as possessing plug means for substantially blocking the steam discharge means when the plug means in is a first position but not blocking the steam discharge means when plug means is in a second position. Means are also provided for urging the plug means to the first position and resisting movement of the plug means from assuming the second position.

DETAILED DESCRIPTION OF THE INVENTION

Figure 1:
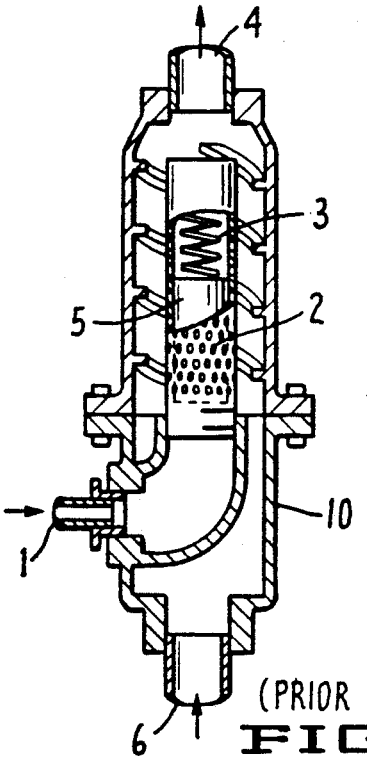
(PRIOR ART) FIG. 1.
FIG. 1 is a depiction of a prior art modulating system.

FIG. 1 has been previously discussed as being representative of the state of the art of modulating injector systems, in this case, employing piston control. This design provides certain advantages over disparger, mixing tees and Venturi-type systems. The piston 5 maintains a differential pressure between steam and water pressures preventing pressure equalization and eliminating steam-water hammer. Because it compensates automatically for changes in steam pressure, inlet-water pressure and hot-water demand, the system, when properly instrumented, provides a wide range of turndown capabilities and accurate temperature control under varying load conditions. However, as noted in the article cited previously from Chemical Engineering in its June 28, 1982, issue, the author recognized that a piston controlled modulating system has moving parts and very small holes that can sometimes, depending upon the quality of the water or liquid being used, get stuck or plugged. The device of the present invention is intended to provide the advantages of such a system without any significant disadvantages.

Figure 4:
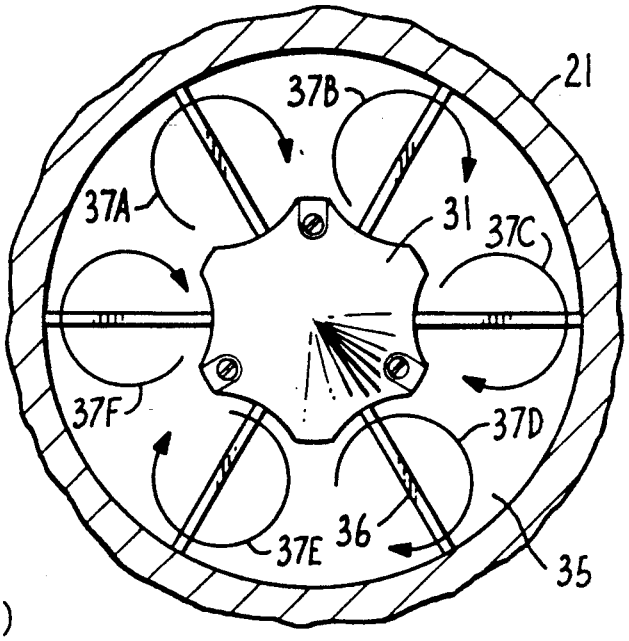
FIG. 4 is a plan view of the device of the present invention taken along 4—4 of FIG. 3.
Figure 2:
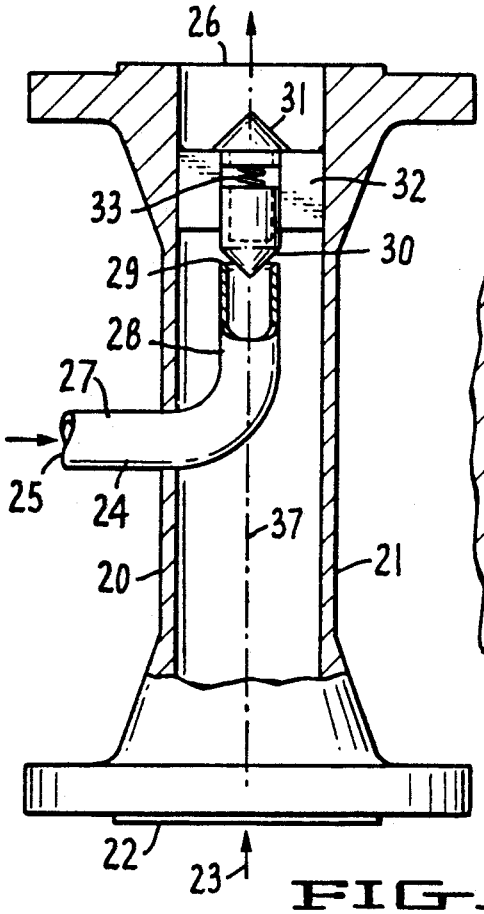
FIG. 2 is a partially cutaway side elevational view of the device of the present invention.
Figure 3:
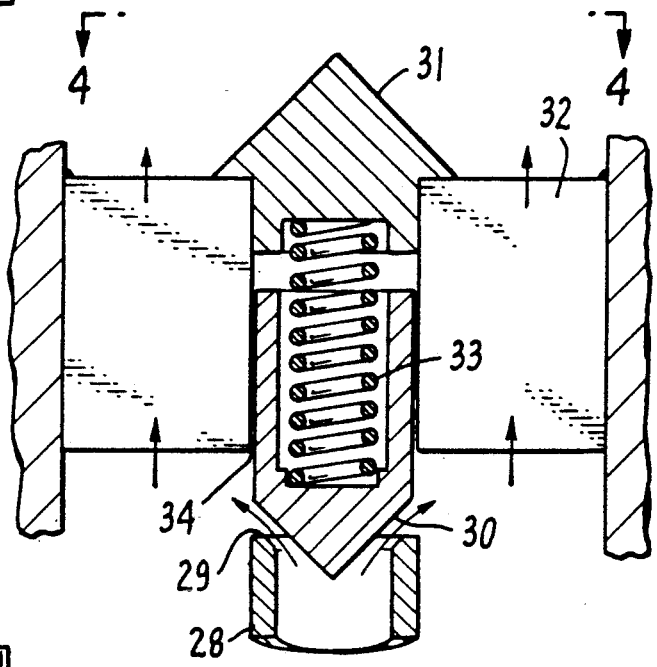
FIG. 3 is a cross-sectional view showing the detail of the mixing element employed in the device of the present invention.

The present invention is illustrated in FIGS. 2, 3 and 4. Turning first to FIG. 2, the device of the present invention shown as device 20 in partial cross-section is depicted by substantially cylindrically-shaped conduit 21 having inlet 22 and outlet 26. Inlet 22 is intended to receive a fluid such as water in the direction of arrow 23 along the longitudinal axis 37 of device 20.

The means for discharging steam comprises tubular conduit 24 passing through a wall of cylindrically-shaped conduit 21. The tubular conduit 24 is configured substantially in the shape of an L with section 27 of the L passing through a wall of cylindrically-shaped conduit 21 and a second section 28 of the L being substantially within the cylindrically-shaped conduit 21 having a longitudinal axis which substantially coincides with longitudinal axis 37 of cylindrically-shaped conduit 21. As such, steam enters tubular conduit 24 at inlet 25 and is discharged at outlet 29 proximate material mixing apparatus 32.

Material mixing apparatus 32 is in the shape of conduit 21 and comprises a plurality of openings 35 (FIG. 4) housing mixing elements 36 which induce a rotational angular velocity to the fluid stream passing therethrough. The material mixing apparatus is further characterized a possessing plug means 30. Plug means 30 is configured to substantially block steam discharge means 24 at its outlet 29 when in a first position but not block the steam discharge means when plug means 30 is in a second position. This is accomplished by employing means for urging the plug means to this first position. Plug means 30 as well as downstream cap 31 are shown to be generally in the shape of a cone. Plug means 30 is shown to possess a pointed end facing upstream and a base portion facing downstream, the base portion being sized to slidably move within the material mixing apparatus along its inner wall 34 in response to steam pressure in the tubular conduit which is resisted by urging means shown in FIG. 3 as preferably being a stainless steel spring 33. When the steam pressure is below a threshold value, plug means 30 at least partially enters the tubular conduit at its exit 29 and is not pushed away from that location until steam pressure within tubular conduit 24 provides a force stronger than that exerted by urging means 33. Once this has been accomplished, steam exits at 29 and passes over and around plug means 30 to pass within mixing means 32 through orifices 35.

Orifices 35 are generally of the type disclosed in Applicant's prior U.S. Pat. Nos. 3,923,288 and 4,614,440, the disclosures of which are hereby incorporated by reference. The mixing elements contemplated for use herein are intended to induce a rotational velocity to the fluid passing therethrough. In practice, it is intended that each of the mixing elements induce or impart the same rotational sign to the fluid passing through the openings 35.

The benefits derived from using the static mixing device shown in FIGS. 3 and 4 and in U.S. Pat. Nos. 3,923,288 and 4,614,440 cannot be overly emphasized. The mixing elements 36, being all of the same sign produce sets of rotational vortexes that impinge on each other greatly enhancing mixture of the steam into the liquid stream. Not only do the vortex pairs 37A/37B, 37B/37C, 37C/37D, 37D/37E, 37E/37F and 37F/37A impinge upon each other, non-adjacent pairs such as 37A/37D, 37B/37E and 37C/37F among others also establish impingement points.

The interaction at these impingement points makes the vortexes mutually destroy themselves resulting in zero net rotational forces at the exit. This avoids the problem of centrifugal separation of gas (steam) and liquid (water) while providing superior mixing.

In viewing the above discussion and appended claims, it becomes readily apparent that in practicing the present invention, one is able, for the first time, to provide a modulating system which eliminates prior art injector tube 2 and thus eliminates the plugging problems of prior devices. The present mixing means fully integrates steam injection with a moving fluid stream which efficiently transfers those BTU's contained within the steam to the fluid.

In view of the foregoing, modification to the disclosed embodiments can be made while remaining within the spirit of the invention by those of ordinary skill in the art. As such, the scope of the invention is to be limited only by the appended claims.

I claim:

1. A device for the injection and mixing of steam into a fluid stream comprising:

a. a substantially cylindrically-shaped conduit having a longitudinal axis and substantially circular cross-section for carrying said fluid stream, said conduit also being provided with an inlet for accepting said fluid stream and an outlet for discharging said fluid stream along said longitudinal axis;

b. means for discharging steam substantially proximate said longitudinal axis within said cylindrically shaped conduit;

c. material mixing apparatus for mixing said steam with said fluid stream which is in the shape of said conduit which comprises a plurality of openings housing mixing elements which each induce a rotational angular velocity of the same sign to the fluid stream passing therethrough, said material mixing apparatus further characterized as possessing plug means for substantially blocking said steam discharge means when said plug means is in a first position but not blocking said steam discharge means when said plug means is in a second position; and d. means for urging said plug means to said first position and resisting movement of said plug means from assuming said second position.

2. The device of claim 1 wherein said urging means comprises a coiled spring.

3. The device of claim 1 wherein said means for discharging steam comprises a tubular conduit passing through a wall of said cylindrically-shaped conduit and terminating as a steam discharge means whose longitudinal axis substantially coincides with the longitudinal axis of said substantially cylindrically-shaped conduit.

4. The device of claim 3 wherein said tubular conduit is configured substantially in the shape of an L with one section of the L passing through a wall of said cylindrically-shaped conduit a second section of the L being entirely within the cylindrically-shaped conduit and having a longitudinal axis which substantially coincides with the longitudinal axis of the cylindrically-shaped conduit.

5. The device of claim 4 wherein said second section of the L of said tubular conduit possesses an upstream end which is joined to said one section of the L and a downstream end which is capable of discharging steam within said cylindrically-shaped conduit.

6. The device of claim 5 wherein said plug means is configured to at least partially eliminate into and substantially block said downstream end of said second section of said L to substantially prevent steam contained within said tubular conduit from entering said cylindrically-shaped conduit.

7. The device of claim 6 wherein said urging means is configured to urge said plug means to block said downstream end of said second section of said L until steam pressure within said tubular conduit reaches a sufficient threshold value to push said plug means away from said downstream end.

8. The device of claim 6 wherein said plug means is in the shape of a cone having a pointed end facing upstream and a base portion facing downstream, said base portion being sized to slidably move within said material mixing apparatus in response to steam pressure in said tubular conduit and urging means.

* * * * *